United States Patent [19]

Ketterer

[11] 3,986,469

[45] Oct. 19, 1976

[54] METHOD FOR BLIND STITCH SEWING

[75] Inventor: Stanley J. Ketterer, Jamesburg, N.J.

[73] Assignee: The Singer Company, New York, N.Y.

[22] Filed: Apr. 7, 1975

[21] Appl. No.: 565,918

Related U.S. Application Data

[62] Division of Ser. No. 527,315, Nov. 26, 1974, Pat. No. 3,908,569.

[52] U.S. Cl. ..... 112/424; 112/262

[51] Int. Cl.[2] ..... D05B 1/24; B32B 7/08

[58] Field of Search..... 112/424, 425, 262, 197–202

[56] References Cited

UNITED STATES PATENTS

| | | | |
|---|---|---|---|
| 830,481 | 9/1906 | Lewis | 112/425 |
| 1,095,199 | 5/1914 | Fink | 112/202 X |
| 1,791,461 | 2/1931 | Becker | 112/424 X |
| 2,636,461 | 4/1953 | Mikolas | 112/197 X |

*Primary Examiner*—H. Hampton Hunter

*Attorney, Agent, or Firm*—Edward L. Bell; Robert E. Smith; Julian Falk

[57] ABSTRACT

A method of sewing a blindstitch hem is disclosed in which the plain hem fold in a garment is introduced wrong side up to a sewing machine of the type having a loop taker moving on a vertical axis located in front of the stitching point and with a thread carrying needle and a latch needle arranged side-by-side laterally of the line of feed of the sewing machine. Sewing machine fittings are disclosed which serve particularly advantageously in producing the blindstitch hem of this invention, including a throat plate fitted with a thread manipulating device for assisting in the concatenation of thread from the thread carrying needle of the latch needle on each stitch, and a latch needle which is easily manufacturable and serves with particular effectiveness in carrying out the method of this invention.

4 Claims, 13 Drawing Figures

METHOD FOR BLIND STITCH SEWING

This is a division, of application Ser. No. 527,315, filed Nov. 26, 1974, now U.S. Pat. No. 3,908,569, dated Sept. 30, 1975.

BACKGROUND OF THE INVENTION

This invention relates to the art of blindstitch hemming; that is, the formation of stitches securing a hem fold in place in such fashion that the noticeability of the stitches on the face of the fabric is minimized.

Specialized commercial sewing machines have long been known for sewing true blind stitches. Since these machines can be used for no other purpose, they are not practical or economically feasible for houshold use.

The blindstitching arrangements which have heretofore been available for use with household sewing machines have required such tedious and skillful work manipulation as to render such arrangements impractical for use by most household sewing machine users. These prior arrangements such, for instance, as that disclosed in the U.S. Pat. No. 2,627,239 do not provide for stitching completely hidden from the fabric face but instead seek to minimize the appearance of the stitches on the fabric face. In the U.S. Pat. No. 2,627,239, the appearance of the stitches on the fabric face is minimized by use of a complicated Z shaped fold of the hem together with use of a special zigzag stitch pattern which shifts the needle only periodically into a position for penetration of the face ply of the fabric and at other times locates the needle to one side where it does not form hem securing stitches but places a line of connecting stitches in the unexposed portion of the hem fold.

It is very difficult to direct the Z shaped fold of goods to the sewing machine needle in such a way that during the infrequent lateral excursions of the needle, the needle merely grazes the edge of the upper fold edge. This is particularly true since for most of the stitches in the pattern, the needle occupies a different lateral postion. To simultaneously give concern to preserving the total width of the hem fold while carefully guiding the edge of the top fold requires a level of skill which most household sewing machine users do not possess.

SUMMARY OF THE INVENTION

It is an object of this invention to provide a method for blindstitch hemming which may be performed on a household sewing machine and in which the work fabric need be presented to the stitching point with only a plain hem fold formed therein. This object of the invention is attained by the provision, in a sewing machine having a loop taker which traverses laterally across the line of stitch formations during loop seizing motion, of a pair of needles arranged side-by-side laterally of the line of stitch formation. One needle carries a sewing thread for the formation of chain stitches and the other needle is formed with a thread engaging hook for cooperation with the first needle in manipulating the thread carried by the loop taker from one needle to the other.

Another object of this invention is to provide means for insuring unerring manipulation of the thread by the sewing machine loop taker and needles in the formation of the blindstitch seam of this invention. This object of the invention is attained by the provision of a thread loop deflector carried by the sewing machine thoat plate and actuated in timed relation to the stitch forming instrumentalitics of the sewing machine for engaging and wrapping the thread from the thread carrying needle around the hook needle.

A further object of this invention is the provision of a novel latched hook needle construction which may be manufactured conveniently utilizing conventional sewing machine needle making tools.

With the above and additional objects and advantages in view, as will hereinafter appear, this invention will now be described in detail with reference to a preferred embodiment illustrated in the accompanying drawings in which.

Figure 1:
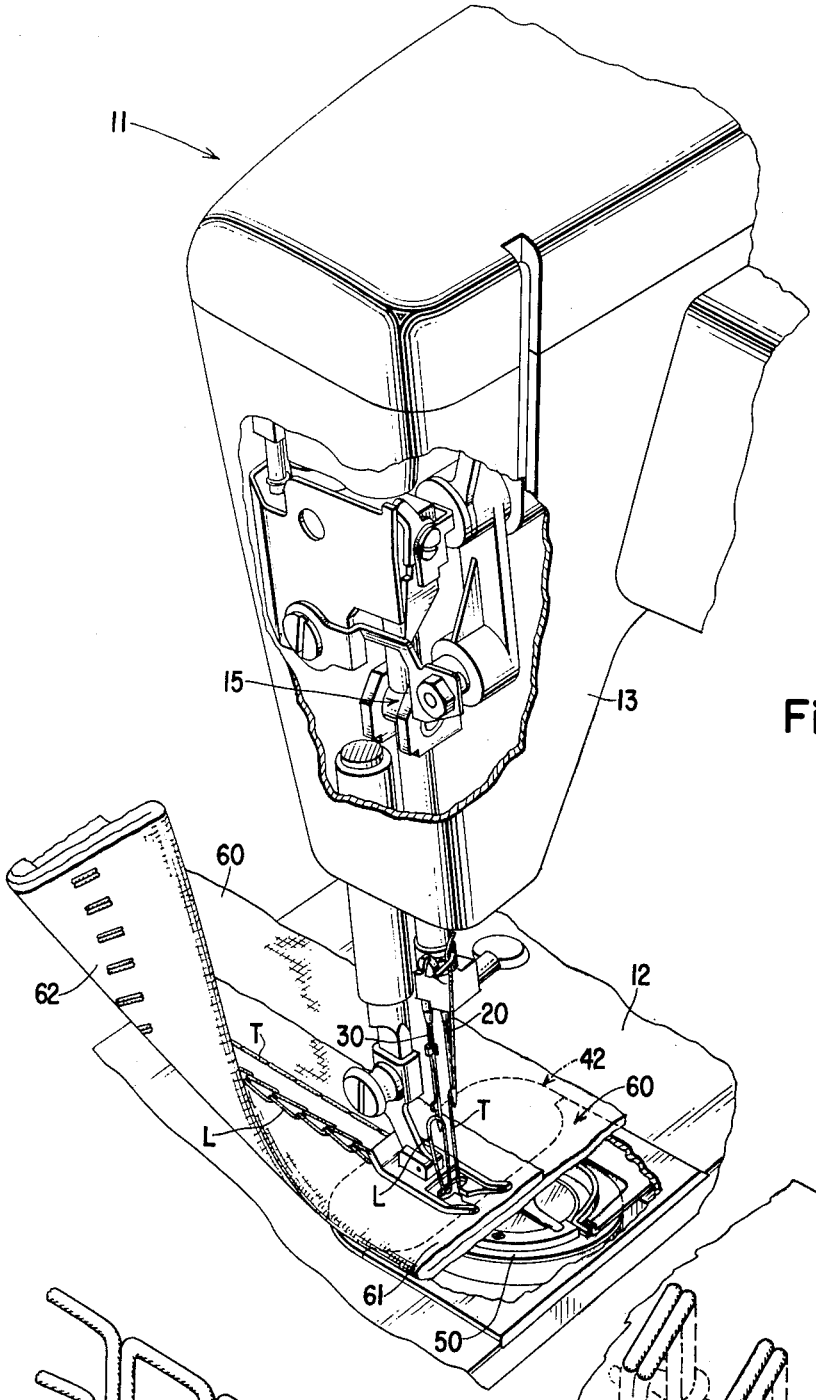
FIG. 1 represents a perspective view of a fragment of a sewing machine having this invention applied thereto and including work fabrics in which a blind stitch hem is being formed in accordance with this invention.

Referring to the drawings, 11 indicates a household sewing machine having work supporting bed 12 and a bracket arm 13 overhanging the bed. A needle bar 14 endwise reciprocable in the bracket arm is associated with a skip stitching device indicated generally at 15 by which the endwise reciprocation of the needle bar may be suspended. The skip stitch mechanism which is illustrated, is built in accordance with the U.S. Pat. No. 3,559,601 of E. Tullman which is incorporated herein by reference although it will be understood that other mechanisms for suspending needle bar reciprocation may serve equally as well.

As shown in FIG. 1, the needle bar carries a pair of needles 20 and 30 arranged in side-by-side relation laterally of the line of work feed of the sewing machine as determined by a work feed dog 40 of a conventional four motion work feed mechanism, which feed dog works upwardly through slots 41 formed in a throat plate 42 carried on the sewing machine bed. The needles pass endwise through an elongated needle hole 43 in the throat plate.

Beneath the throat plate in the bed is disposed a loop taker 50 preferably rotatable on a vertical axis 51 arranged forwardly of the path of needle reciprocation. The loop taker may be constructed in accordance with that forming the subject of the U.S. Pat. No. 3,693,565 which is incorporated herein by reference and which is conventionally adapted to form lock stitches. As used in the present invention, however, a chain stitch seam will be formed and any conflict between lock stitch and chain stitch modes may be eliminated by removing all thread from the bobbin in the loop taker.

Of the pair of needles 20 and 30 carried on the needle bar 14, the needle 20 is a conventional thread carrying sewing machine needle. The needle 30, however, is a hook needle. As will be described hereinbelow, the hook needle 30 disclosed in the drawings is a particularly advantageous form of construction, but a wide variety of hook needles could be utilized as well in carrying out the teachings of this invention.

Figure 5:
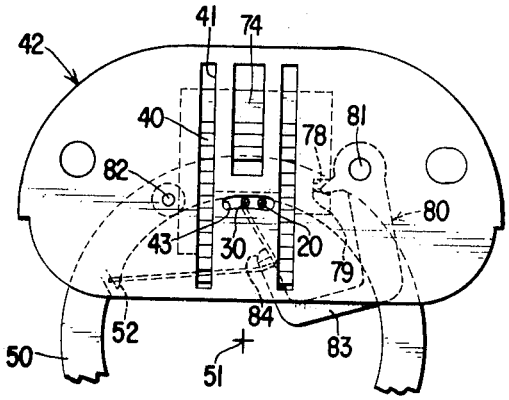
FIG. 5 is a top plan view similar to that of FIG. 4 but taken near the completion of the idle return stroke of the feed dog as the needle is withdrawn from the work.

As shown in FIG. 5, the thread T from the thread carrying needle 20 is seized during each needle penetration by the beak 52 of the loop taker 50 and carried laterally by the loop taker across the hook needle 30.

The hook needle on its next withdrawal from the work carries a loop L of the thread T upwardly through the work and through any previously seized loop of thread which may have been held on the hook needle. As a result, the single thread chain stitch concatenation of FIG. 2 is formed by operation of the sewing machine depicted in FIG. 1.

In order to form a blind stitch hem in a garment 60, a plain hem fold 61 is formed inwardly from the face 62 of the garment along the garment edge and the hem folded garment is placed face down on the sewing machine bed in which position the hem fold is directed to the stitching point.

Figure 2:
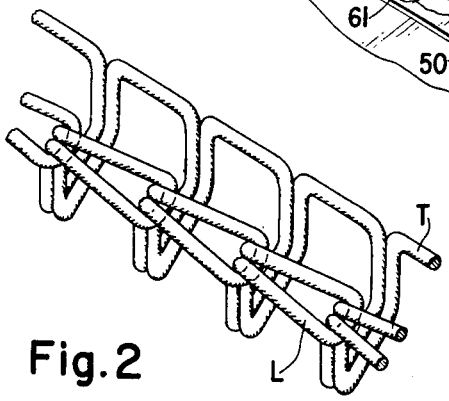
FIG. 2 is a perspective view of the thread concatentation as viewed from the top during the formation of a seam in accordance with this invention.
Figure 3:
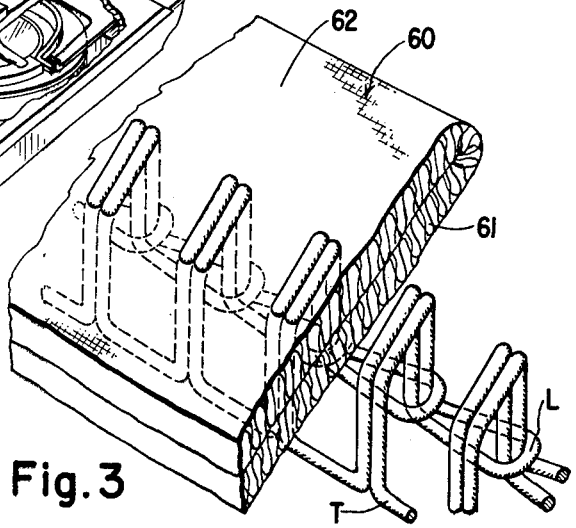
FIG. 3 is a perspective view of the thread concatenation, including a fragment of the work fabrics, as viewed from the bottom during the formation of a seam in accordance with this invention.

FIG. 3 illustrates the appearance of the single thread chain stitch seam from the face of the garment. The only thread segments which are visible are those which extend between the needles 20 and 30 during stitch formation. It is pointed out that the spacing between the needles 20 and 30 in FIGS. 1 to 3 is somewhat exaggerated for clarity of illustration, and that the closer the needles can be maintained, the less conspicuous will be the thread segments visible on the face of the garment. Particularly if a long stitch length is utilized, i.e. considerable distance is placed between successive needle penetrations along the length of the seam, and if suitable color of thread is chosen to blend with the color of the fabric, the segments of thread in the seam which do appear on the face of the garment can be made hardly noticeable. By use of the skip stitch mechanisms of the sewing machine, a stitch spacing is obtainable far in excess of the maximum which can be produced by use of the sewing machine feed mechanism alone.

Figure 4:
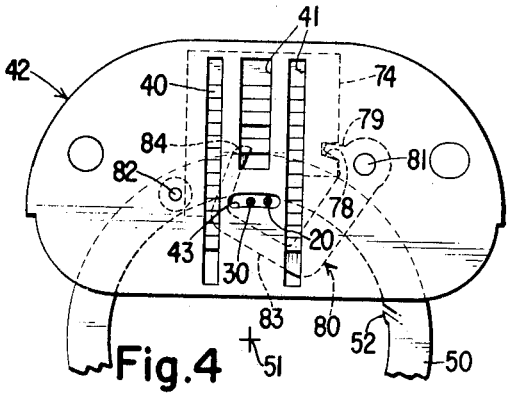
FIG. 4 is a top plan view of a sewing machine throat plate including fragments of the sewing machine loop taker and work feed dog taken near the completion of a forward feed stroke substantially at the beginning of needle penetration of the work.
Figure 6:
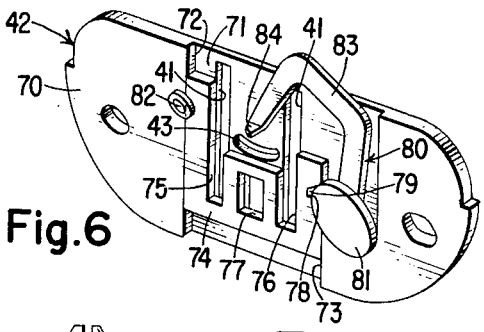
FIG. 6 is a perspective view of the underside of the throat plate.

The blind stitch seam illustrated in FIGS. 1, 2, and 3 can be produced using just the needles 20 and 30 and the loop taker 50. Greater certainty, however, of seizure of the thread T by the hook needle 30 can be attained by the provision of a thread deflecting means on the throat plate 42 as shown in FIGS. 4, 5, and 6 and which will now be described.

The underside 70 of the throat plate 42 is formed with a recess 71 having opposite straight sides 72 and 73 which define guiding surfaces for a reciprocating block 74 which is formed with slots 75 and 76 as well as an opening 77 adapted to embrace the feed dog 40 of the sewing machine so that the reciprocating block will partake of the feed motions of the feed dog. The reciprocating block 74 is formed along one side with a notch 78 which is engaged by a tooth 79 projecting from an oscillating thread deflecting member 80 pivotally supported in the recess 71 beneath the throat plate on a headed rivet 81. The headed rivet 81 also projects over the reciprocating block 74 and cooperates with another headed rivet 82 which projects over the opposite side of the block to restrain the block in place between the recess sides 72 and 73.

The oscillating thread deflecting member 80 is formed with a curved arm 83 terminating in an offset thread engaging finger 84 adapted, as shown in FIG. 5, to engage and wrap the thread T around the hook needle 30 during the upstroke of the needles as the feed dog moves forwardly into position to begin a work feed stroke. The certainty of thread loop seizure by the hook needle is then greatly augmented by this provision of the thread loop deflecting means.

Although any one of a wide variety of hook needles may be utilized with this invention, the hook needle which forms a part of the preferred form of this invention, as disclosed in the accompanying drawings, is particularly advantageous because of its simplicity, ease of manufacture, and superior operating characteristics.

Figure 7:
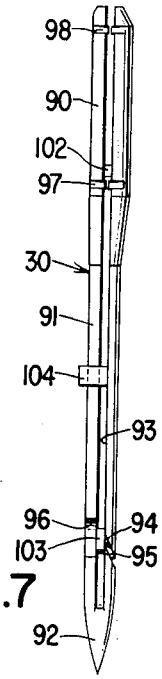
FIG. 7 is an elevational view of the hook needle of this invention looking into the lengthwise groove.
Figure 8:
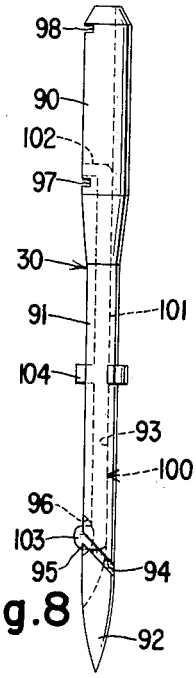
FIG. 8 is an elevational view of the hook needle of this invention taken at right angles to that of FIG. 7.

As shown in FIGS. 7 and 8, the hook needle 30 comprises a butt portion 90, shank 91 pointed free extremity 92 having interrelation similar to that of any conventional sewing machine needle. One lengthwise groove 93 is formed opening along one side of the needle and extending continuously from the butt to the pointed free extremity. Near the pointed free extremity the needle shank at one side of the groove 43 is formed with an inclined lateral slot 94 which opens onto the groove 93 to define a thread engaging hook 95. The needle shank at the side of the groove 93 opposite the thread engaging hook 95 is formed with a recess 96 serving to expose the thread engaging hook 95. At the butt 90, the sidewalls of the groove 93 are deformed at two spaced locations 97 and 98 to provide travel stops limiting sliding movement along the groove 93 of a latch member 100.

Figure 9:
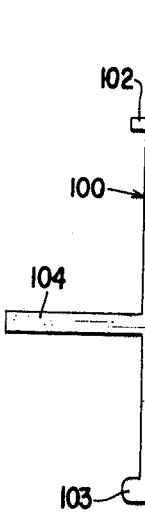
FIG. 9 is an elevational view of the sliding latch for the hook needle as manufactured.

As shown in FIG. 9, the latch member 100 is preferably formed as a sheet metal stamping and includes a lengthwise elongate body portion 101 formed at one extremity with a small lateral extending stop lug 102 and at the other extremity with a laterally extending hook shield 103. Between the ends, the body portion 101 is formed with a lateral extension 104 of considerable length which, as shown in FIG. 12, will ultimately be wrapped around the needle shank to retain the latch member in the needle groove 93.

Figure 10:
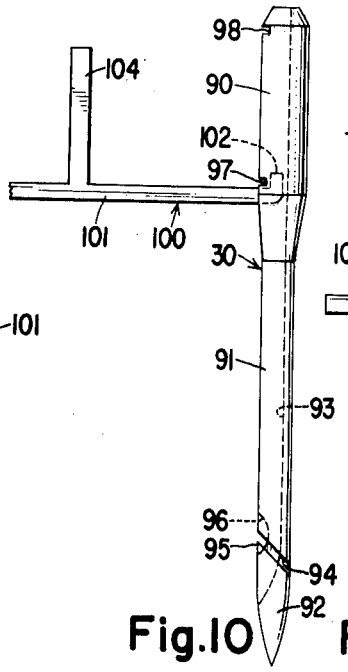
FIG. 10 is an elevational view of the hook needle showing the sliding latch being inserted therein.
Figure 11:
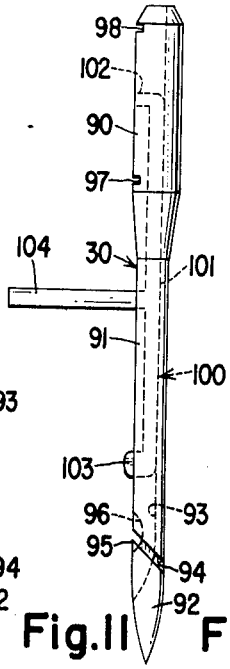
FIG. 11 is an elevational view similar to FIG. 10 but showing the sliding latch positioned completely within the needle groove.
Figure 12:
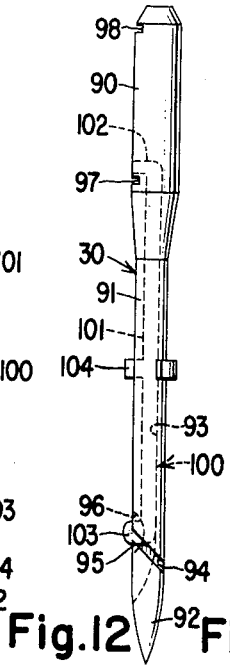
FIG. 12 is an elevational view of the completed needle of this invention.
Figure 13:
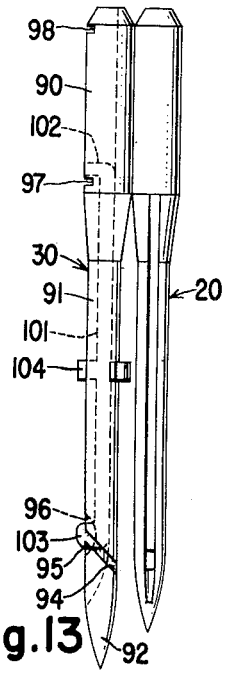
FIG. 13 is an elevational view of an assembly of both a threading carrying and a hook needle for use in this invention.

FIGS. 10, 11 and 12 illustrate the manner in which the latch member is assembled into the groove 93 of the hook needle 30. First, the stop lug is inserted into the groove beneath the bottom travel stop 97 with the latch member body arranged at right angles to the needle. The latch member is then turned 90° to position the body portion 101 in the groove with the stop lug arranged between the travel stops. Lastly, the extension 104 is deformed and wrapped loosely around the needle shank 91 to complete the hook needle. It will be noted that the hook shield 103 protrudes slightly out of the groove 93 so that it can be influenced by the passage of the needle into and out of work fabrics to effect relative movement of the latch member along the needle groove to the extent permitted by the travel stops 97 and 98. When the shield 103 occupies a position opposite the hook 95, moreover, the protrusion of the shield out of the groove 93 protects the hook preventing escape of thread loops thereon or inadvertent snagging of other fibers, for instance, fibers of the work fabric. In this position, the shield also serves as a guide to direct off the needle and past the hook any loops of thread which may be engaged thereon.

Having set forth the nature of this invention, what is claimed herein is:

1. The method of forming a blind stitch hem along a garment edge comprising the steps of;

a. forming a hem fold along a garment edge away from the exposed face of the garment, b. subjecting said hem fold to successive penetrations from the hidden side by a pair of needles arranged side-by-side of which one of said needles is a thread carrying needle and the other of said needles is a hook needle with a latch, c. transferring a loop of thread from said thread carrying needle onto the hook of the hook needle during each penetration of said garment by said pair of needles, d. and forming a successive stitch chain on the hidden side of said garment by successive concatenations of said loops of thread which are directed on to said hook needle, and exhibiting only those segments of thread which extend between said needles on the exposed face of the garment.

2. The method of forming a blind stitch hem along a garment edge comprising the steps of;

a. forming a hem fold along the garment edge away from the exposed face of the garment, b. placing the hem fold with the exposed face of the garment directly upon the bed of the sewing machine having an endwise reciprocating needle bar, a work feed mechanism for establishing a line of stitch formation and a loop taker beneath said bed with a thread seizing beak movable in loop seizing motion transversely across the line of stich formation, c. subjecting the hem fold to the endwise reciprocation of a pair of needles carried by the sewing machine needle bar in tandem relation relatively to the path of loop seizing motion of said loop taker beak of which that needle toward which the loop taker beak approaches in loop seizing motion is a thread carrying needle from which the loop taker beak seizes a thread loop, and of which pair of needles the other needle is a hook needle, d. directing loops of thread seized by said loop taker beak from the thread carrying needle to the hook needle, and e. forming a successive chain of thread loops on the hidden side of said garment by successive concatenations of said loops of thread which are directed on to said hook needle, and exhibiting only those segments of thread which extend between said needles on the exposed face of the garment.

3. A blind stitched hem for a garment fabric edge comprising a fold formed along said garment edge away from the exposed face thereof, and a line of stitching securing said fold in place against the inside face of the garment fabric, said line of stitching comprising a single thread formed into a series of loops extending in a first line of fabric penetrations through the fold and then through the garment fabric to the exposed face of garment, each of said series of loops then extending laterally of said first line of fabric penetration and formed into a second line of fabric penetrations through the garment fabric and then through the fold to the inside face of the garment, the extremity of each of said loops extending from said second line of fabric penetrations accommodating therethrough in chain-like fashion the succeeding loop of thread as said succeeding loop of thread emerges from said second line of fabric penetration.

4. The method of forming a blindstitch hem along a garment edge comprising the steps of:

a. folding a hem fold along a garment edge away from the exposed face of the garment, b. passing a loop of sewing thread through both the hem fold and the body fabric of the garment from the hidden side to the exposed face, c. directing said thread loop from the place of emergence on the exposed face of the garment in a direction perpendicular to the hem fold, d. passing the free end of said loop of thread back through both the body fabric and through the hem fold to the hidden side, e. extending one limb of said thread loop laterally along said hem fold on the hidden side, f. passing a succeeding loop in said laterally extended thread limb through said hem fold and said body fabric to the exposed face, g. directing said succeeding thread loop from the place of emergence on the exposed face of the garment in the same direction perpendicular to the hem fold as the previously formed thread loop, h. passing the free end of said succeeding loop of thread back through both the body fabric and the hem fold and through the previously formed thread loop, i. and continuing so to form and manipulating successive thread loops so as to form a chain of stitches.

* * * * *